US005864272A

United States Patent [19]

Hoffmann

[11] Patent Number: 5,864,272

[45] Date of Patent: Jan. 26, 1999

[54] SWITCH HAVING AT LEAST TWO STABLE POSITIONS, ESPECIALLY FOR A MOTOR VEHICLE

[75] Inventor: Bertrand Hoffmann, Chilly Mazarin, France

[73] Assignee: Valeo Electronique, Creteil, France

[21] Appl. No.: 256,596

[22] PCT Filed: Dec. 2, 1992

[86] PCT No.: PCT/FR93/01183

§ 371 Date: Oct. 25, 1994

§ 102(e) Date: Oct. 25, 1994

[87] PCT Pub. No.: WO94/12997

PCT Pub. Date: Jun. 9, 1994

[30] Foreign Application Priority Data

Dec. 2, 1992 [FR] France ..... 92 14518

[51] Int. Cl.[6] ..... H01H 9/00

[52] U.S. Cl. ..... 335/207; 335/78

[58] Field of Search ..... 335/78–86, 205–7

[56] References Cited

U.S. PATENT DOCUMENTS 4,199,741 4/1980 Paulet .
4,317,969 3/1982 Riegler et al. ..... 335/205
4,481,389 11/1984 Johnson ..... 335/205

FOREIGN PATENT DOCUMENTS 1167718 11/1958 France .
2134955 12/1972 France .
2370350 6/1978 France .
2552229 5/1977 Germany .
4109544 9/1992 Germany .
809090 2/1959 United Kingdom .

*Primary Examiner*—Lincoln Donovan
*Attorney, Agent, or Firm*—Morgan & Finnegan, LLP

[57] ABSTRACT

The switch having at least two stable positions comprises a housing (30), an operating member (5), carried movably by the housing (30), and indexing means (1) partly carried by the operating member (5) and partly by the housing (30). The indexing means (1) comprise a magnetic circuit having at least one permanent magnet (2) associated with at least one counter-target (21) and a target (18) for closing the magnetic field and disposed in facing relationship to the counter-target at each stable position. One of the elements comprising the target and the counter-target with its permanent magnet being carried by the operating member (5), while the other one of the said elements is carried by the housing (30).

11 Claims, 6 Drawing Sheets

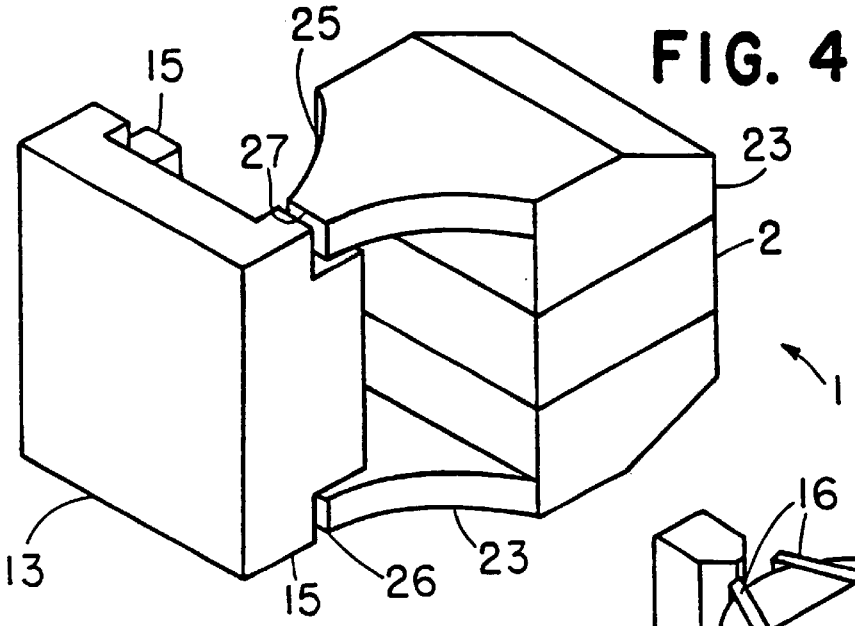
FIG. 4
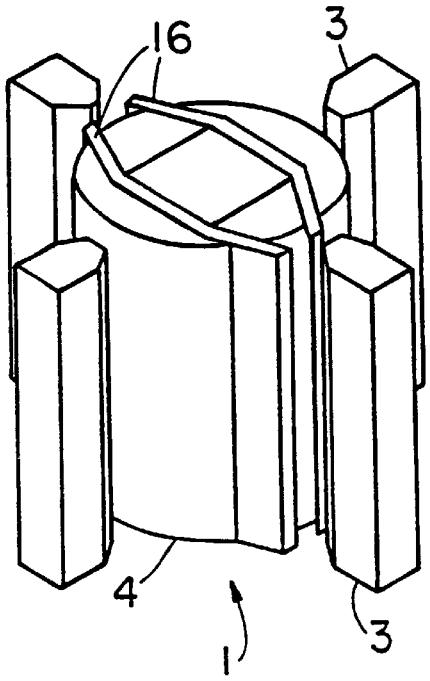
FIG. 6
FIG. 5
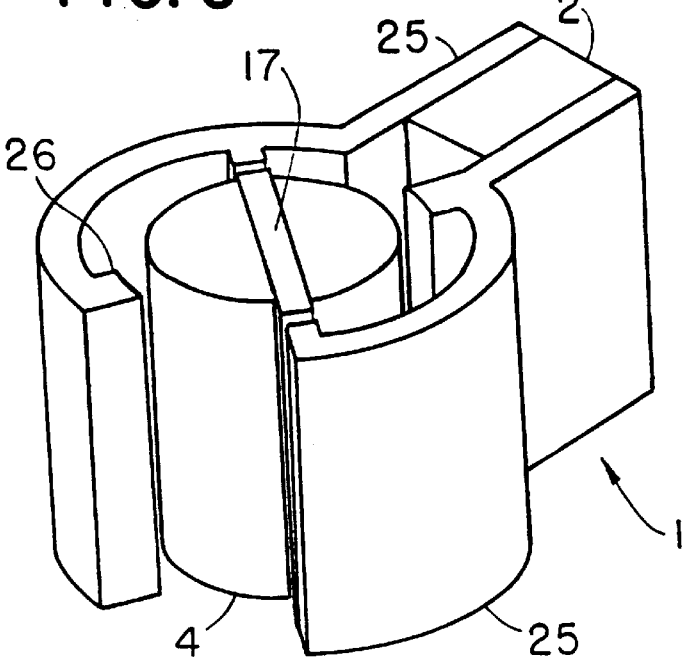

SWITCH HAVING AT LEAST TWO STABLE POSITIONS, ESPECIALLY FOR A MOTOR VEHICLE

The present invention is concerned with switches having at least two stable positions, especially for motor vehicles, of the kind comprising a support housing carrying a movable operating member, adapted to occupy the stable positions, together with indexing means carried partly by the operating member and partly by the housing so as to define the stable positions of the operating member.

As is known, in each stable position the switch performs a predetermined function, as is described for example in the document FR-A-2 392 479.

In that document, the indexing means make use of notches formed in the housing, together with a movable plunger which is acted on by a return spring carried by the operating member. The opposite is also possible, as is disclosed in the document FR-A-2 495 373.

Such a switch is noisy because the plunger is first caused to retract and then to extend sharply, in order to pass from one stable position to the other.

This is why there is provided, in the document FR-A-2 654 868, an arrangement having a plunger which is provided with a roller in contact with a resiliently deformable leaf which follows the shape of the notches.

Such an arrangement increases the number of components.

Whatever solution is adopted, wear takes place, and problems of reliability arise which are due in particular to fatigue effects and to dangers of breakage of the resilient elements (springs, leaves), of the switch.

In addition, these switches are sensitive to corrosion and pollution, due to the fact that the indexing means include components which are in movable contact with each other, so that particles can become detached and may, for example, make the electrical, hydraulic or other circuits dirty, as also the articulations which are included in such a switch.

This pollution may also arise from the grease which is usually applied for attenuating noise effects.

Finally, problems of control sensation occur because, in these types of switch, frictional effects occur which hinder the movement of the operating member, with a risk of jamming, and one gets a feeling of control by fits and starts. In this connection, when passing from one stable position to another, it is first necessary to compress the return spring of the plunger, which subsequently extends, these techniques arising from the flexibility of an element which has to be deformed elastically with a force that increases and then decreases in order to move from one stable position to another.

An object of the present invention is to overcome these drawbacks in a simple and inexpensive manner, and accordingly to provide novel indexing means which are less noisy and less subject to corrosion and pollution, while giving the user a more gentle sensation when actuating the operating member.

In accordance with the invention, a switch of the type described above is characterised in that the indexing means comprise a magnetic circuit having at least one permanent magnet associated with at least one counter-target and a target for closing the magnetic field and disposed in facing relationship to the counter-target at each stable position, one of the elements comprising the target and the counter-target with its permanent magnet being carried by the operating member while the other one of the said elements is carried by the housing, so as to define at least two stable positions, at least two targets and one counter-target, or the reverse, being provided for this purpose.

Thus, thanks to the invention the indexing means consists of components which do not make contact with each other, so that the noises generated by, for example, the extension of a plunger or vibrations of flexible leaves are avoided.

Wear effects are also diminished, to the benefit of the working life of the switch. This is especially so since the magnet and the target are fixed with respect to the component that carries them.

Friction effects are also avoided, as are pollution phenomena, especially due to the fact that there is no need to grease the magnetic indexing means.

Manufacture of the switch is also simplified, due to the absence of a return spring and/or resilient leaf spring.

It is thus possible to equip the dolly in advance with its counter-targets, or targets as the case may be.

In addition, according to the application, it is possible readily to fit the permanent magnet either transversely or axially.

The actuation of the operating member takes place without any risk of jamming and in a more gentle manner. In this connection, when passing from one stable position to another, the magnetic attraction forces diminish and then increase, contrary to the arrangements in the prior art which lead to an initial increase in force.

It will be appreciated that in this way, the magnetic attraction force will position the target with respect to its associated magnet and will ensure the stability of the position, thus performing the indexing operation. By multiplying the number of targets and/or magnets, the number of positions can readily be multiplied.

If the operating member is left in an intermediate position between two stable positions, the magnetic attraction force will draw the magnet towards the target closest to it.

In addition, by adjusting the air gap included in the magnet circuit, it will be possible easily to optimise the force-displacement curve for improved comfort of the user.

It will be appreciated that the arrangement in accordance with the invention is applicable, inexpensively, to a reduced number of permanent magnets, which may thus be of large size. This reduced number of magnets favours good stability of the positions, the targets or the counter-targets being well spaced apart with respect to each other.

Preferably a pole piece is associated with each pole of the permanent magnet. These pole pieces enable the power of the magnet, and thus its size, to be reduced.

Thanks to the pole pieces it is possible to concentrate the open magnetic flux, with the target serving to close the flux. This also leads to an increase in the distance between the targets, which favours improved stability of the positions.

The said pole pieces are preferably so profiled as to increase further the flux in the magnetic field. The target and/or the pole pieces preferably have a free end which is trimmed so as to increase the magnetic attraction forces.

It is also possible, by omitting a target, to provide a switch having an unstable position with magnetic return.

The description that follows illustrates the invention with reference to the attached drawings, in which:

FIGS. 1 to 6 are diagrammatic views of the magnetic indexing means in accordance with the invention;

Figure 1:
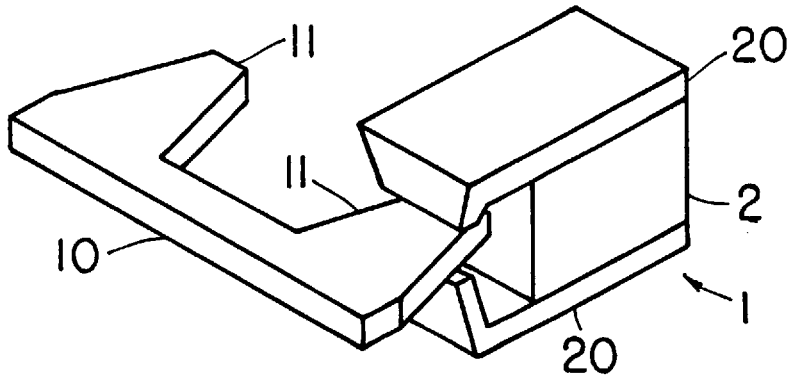

The switch shown in FIGS. 7 to 14 is an auxiliary equipment switch for a motor vehicle having at least two stable positions, especially for lighting, heating, air conditioning, screen wiping and ventilation of the vehicle.

The switch has a support housing 30, with a rocker dolly, or an operating member 5-50 being mounted for movement with respect to the housing 30 and being carried by the latter. This movable member 5-50 is arranged to occupy the stable positions. The switch also has indexing means 1 which are partly carried by the operating member 5-50 and partly by the housing 30, so as to define the stable positions of the operating member 5-50. In this example, passage from one stable position to the other is by circumferential displacement, which may be of infinite radius, of the operating member.

In accordance with the invention, a switch of the type described above is characterised in that the indexing means 1 include a magnetic circuit having at least one permanent magnet 2 associated with at least one counter-target or pole piece 20, 21 . . . and a target 11, 12, 13 . . . for closing the magnetic field, arranged in facing relationship to the counter-target at each stable position, with one of the elements comprising the target and the counter-target with its permanent magnet being carried by the operating member 5-50, while the other one of the elements is carried by the housing 30, so as to define at least two stable positions, at least two targets and one counter-target, or the reverse, being provided for this purpose.

More precisely, in FIGS. 1 to 5, pole pieces 20, 21, 22, 23, 25 are associated with each pole of the permanent magnet 2, which is for example of ferrite, or rare earths, or neodymium-iron-boron. These pieces, together with the targets 11, 12, 14, 15, 17, are in this example in magnetic material or ferromagnetic material having a low reluctance. They are preferably of soft iron.

The said pole pieces define counter-targets associated with the permanent magnet 2. They enable the power of the magnet, and thus the size of the latter, to be reduced. In this connection, by virtue of the pole pieces, it is possible to increase the density of the magnetic field, with the latter channeling the magnetic flux.

The presence of these counter-targets, separate from the magnet 2, is of course not necessary. This permanent magnet 2 may be so profiled as itself to define a counter-target. In this example the portion of the housing 30 which partly carries the indexing means is of a non-magnetic material.

In FIG. 6, the targets 16 are also of low reluctance magnetic or ferromagnetic material, being preferably of soft iron.

In FIGS. 1 to 4, the permanent magnet 2 with its pole pieces (counter-targets) is carried by the operating member 5-50, while in FIGS. 5 and 6 the targets 16, 17 are carried by the operating member, and more precisely by a spigot 4 which is part of the said operating member.

In FIGS. 1 to 4, three targets are provided, and in the interests of simplicity only two of these latter are shown, as in FIGS. 5 and 6.

In FIG. 5, there is only one target 17 and four counter-targets 26 which are defined by the pole pieces 25.

In FIG. 6, twin targets 16 are provided, together with four permanent magnets 3, the end of which, facing towards the spigot 4, is profiled so as to define a counter-target.

As will have been understood, it is possible to reverse the structures. When the housing is of a suitable size, it is possible to provide at least three permanent magnets and three counter-targets carried by the housing, together with a single target carried by the operating member. All combinations are possible.

In FIG. 1, the two pole pieces 20 are secured magnetically on the magnet 2, each of them being associated with one of the poles of the permanent magnet 2. The assembly 20, 2 is generally in the form of a U, the base of which is defined mainly by the magnet 2, and its branches by the pole pieces 20, the free ends of which are bent over towards each other so as to define a precise air gap between the free ends of the twin pole pieces 20.

This arrangement enables the magnetic flux to be concentrated. These pole pieces thus have free ends which are profiled in the form of a pincer so as to increase the flux of the magnetic field.

The target 11 is a lug of generally trapezoidal shape, and penetrates between the pieces 20 into the air gap delimited by these latter. The distance between the free ends of the pieces 20 is thus a function of the thickness of the target 11, which extends parallel to the main portion of the pieces 20.

The target 11 could of course consist of a rectangular lug, but it will be appreciated that the trapezoidal shape of the target 11, produced by trimming material from a rectangular lug, leads to an increase in the magnetic attraction forces. Once the magnet 2 with its associated counter-target defined by the twin pole pieces 20 is displaced with respect to the target 11, an asymmetry is created due to the inclined shape of the side edges of the target 11, so that the magnetic attraction forces are increased. The targets 11 are joined together by bar elements 10 so that they form a unitary assembly which can be easily fixed into the component that carries it, which is preferably of plastics material for this purpose, so that it is easily possible, for example, to carry out a moulding-on operation.

Figure 2:
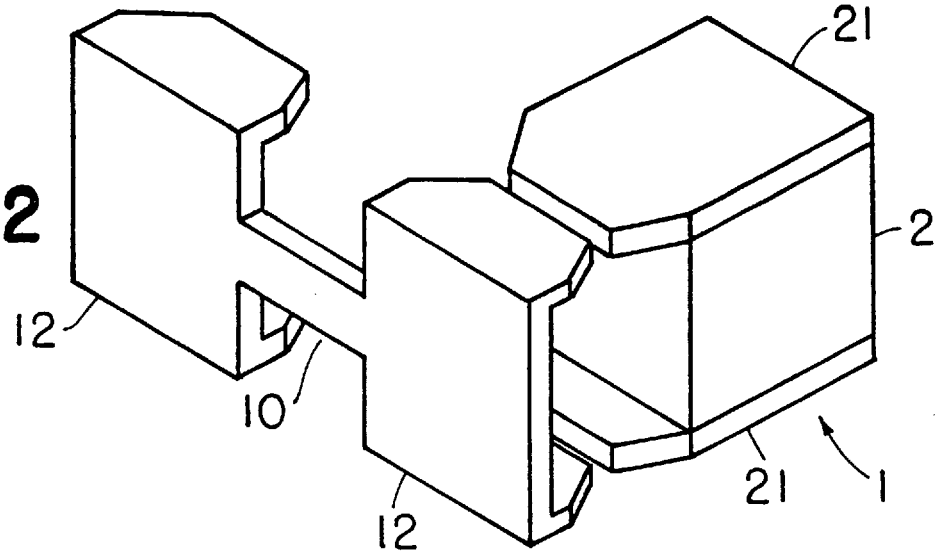

In FIG. 2, the magnet 2 with its counter-target having twin pole pieces 21 is displaced with respect to the targets 12, which are joined together by bar elements 10 as before, but the target 12 is not arranged so as to penetrate between the pole pieces 21.

The pieces 21 have a flat shape, with a trapezoidal end so as to concentrate the magnetic flux, while the targets 12 have the shape of a U having two wings, each of which is directed towards one pole piece 21 in the plane of the latter, the said wings having a trapezoidal end.

An air gap is defined between each free end of a pole piece 21 and the free end, facing it, of the appropriate branch of the target 12, in extension of the associated piece 21. The magnetic field is closed across the target 12: hence the U shape of this latter.

The shape of the target 12 also enables an asymmetry to be created during the relative displacement of the target 12 with respect to the counter-target 21, and therefore enables the magnetic attraction forces to be increased, to the enhancement of good stability of the switch as before.

As will have been understood, if the user operates the rocker dolly when the magnet 2, with its pole pieces 21, lies between two targets 12, the operating member will automatically return, by itself and under the action of the magnetic forces, into a stable position, that is to say towards the target 12 that is closest to it.

The switch can thus have an unstable position corresponding to an absence of a target, for the purpose, for example in the context of a screen wiper switch, of controlling the screen washing liquid of the rear wiper, or controlling the temperature in the context of an installation for conditioning the air in the cabin of the vehicle.

Figure 3:
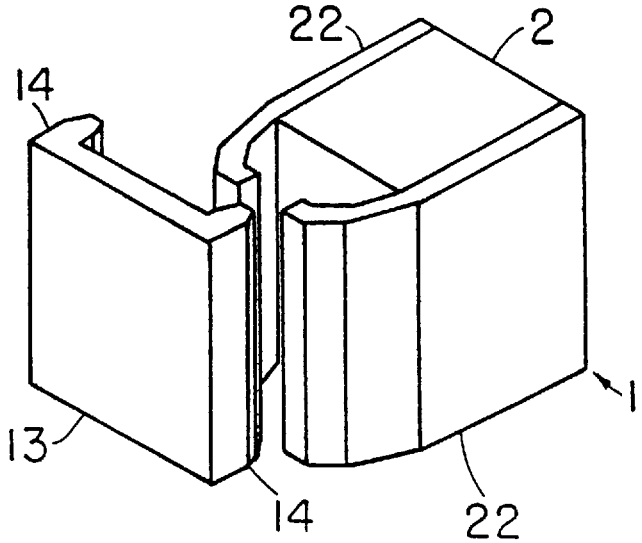

In FIG. 3, the target 14 is in the form of a bar element having a free end of trapezoidal shape, with the targets 14 being joined together through a plate element 13. The pole pieces 22 have a free end which is turned back as in FIG. 1, but with a double bend.

The terminal zones of the free ends, in facing relationship to each other, extend at right angles to the main portion of the pole pieces 22, so as to define an air gap and to attract the target 14 arranged outside the pieces 22 in the immediate vicinity of the pieces 22, so that it closes the magnetic field.

In FIG. 4, the pole pieces 23 are thicker and have a free end having a reduced thickness, with linking curves 25. The target 15 is in the form of a stepped plate, with a free end of rectangular shape which penetrates between the two free ends of the pole pieces 23 and defines two shoulders 26, each of which is in facing relationship to the terminal face 27 of the free end of the appropriate piece 23.

As a result of this shape, maximum magnetic attraction forces are obtained, with excellent closing of the magnetic field by the target 15.

In FIG. 5, the permanent magnet 2 has two pole pieces 25, and each of these is provided with counter-targets, on two ribs 26 which are directed towards the other pole piece so as to define two stable positions. It is of course possible to provide more than two ribs.

The target 17 is in the form of a plate with a central hole for accommodating the spigot 4.

As will have been understood, four counter-targets 26 are formed, each of which is arranged to cooperate with the target 17.

In FIG. 6, the target 16 is doubled up, and consists of two plates 16 with ends which are curved back so as to be directed towards each other. The permanent magnets 3 have a trapezoidal end defining the counter-targets. It is of course possible to provide more than two magnets 3 and more than two stable positions.

Practical embodiments are shown in FIGS. 7 to 14 by way of example.

In FIGS. 7 to 12, the switch is an electrical switch of the same type as that described for example in the document EP 0 403 359, to which reference can be made for fuller details, as also to the documents FR-A-2 607 959 and FR-A-2 607 961 cited in this above mentioned document EP 0 403 359.

This switch may be a lighting switch or a screen wiper switch fitted at the level of the fascia of the motor vehicle. It has a housing 30 of non-magnetic material, in this example of plastics material, having a skirt 32 which is closed by a cover 31 so as to define a ball socket 7 with which a rocker dolly 5 having a ball end 6 is arranged to cooperate. This dolly, which is for actuation by the user, is accordingly mounted pivotally with respect to the housing 30, by which it is carried.

Preferably, and in the usual way, the cover 31 is fixed removably on the skirt, in this example by a clipping action.

Figure 8:
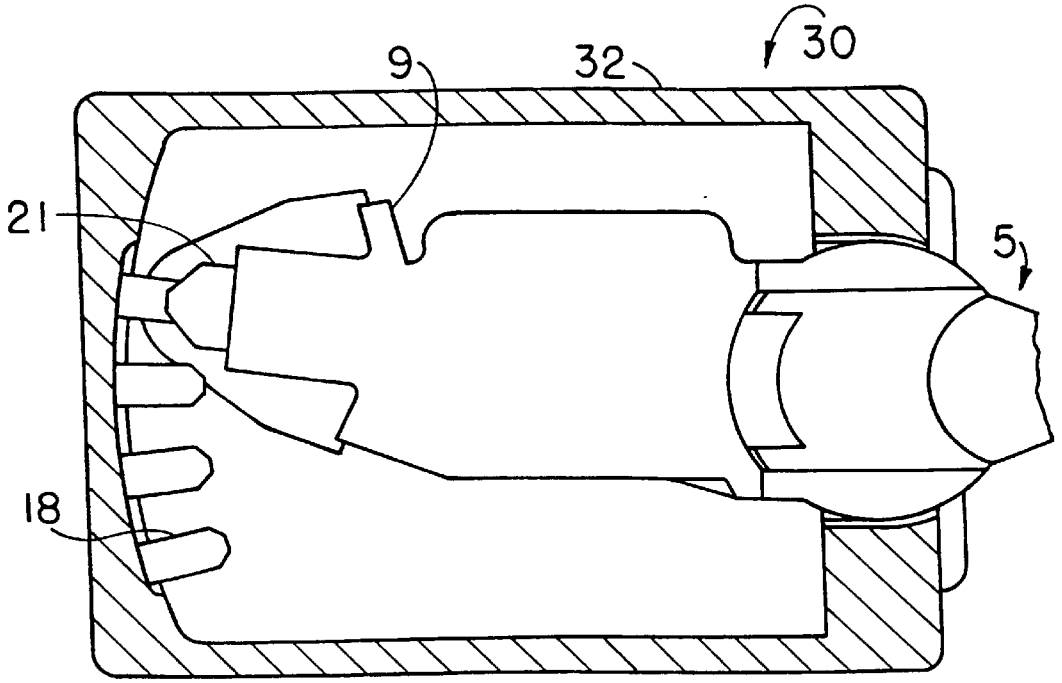
FIG. 8 is a view in the direction of the arrow 8 in FIG. 7, with the cover of the switch being omitted.

The dolly 5, which is of non-magnetic material and in this example of plastics material, is thus able, by virtue of its ball end 6, to perform a movement in rotation within the housing 30 and in the plane of FIG. 8.

Figure 7:
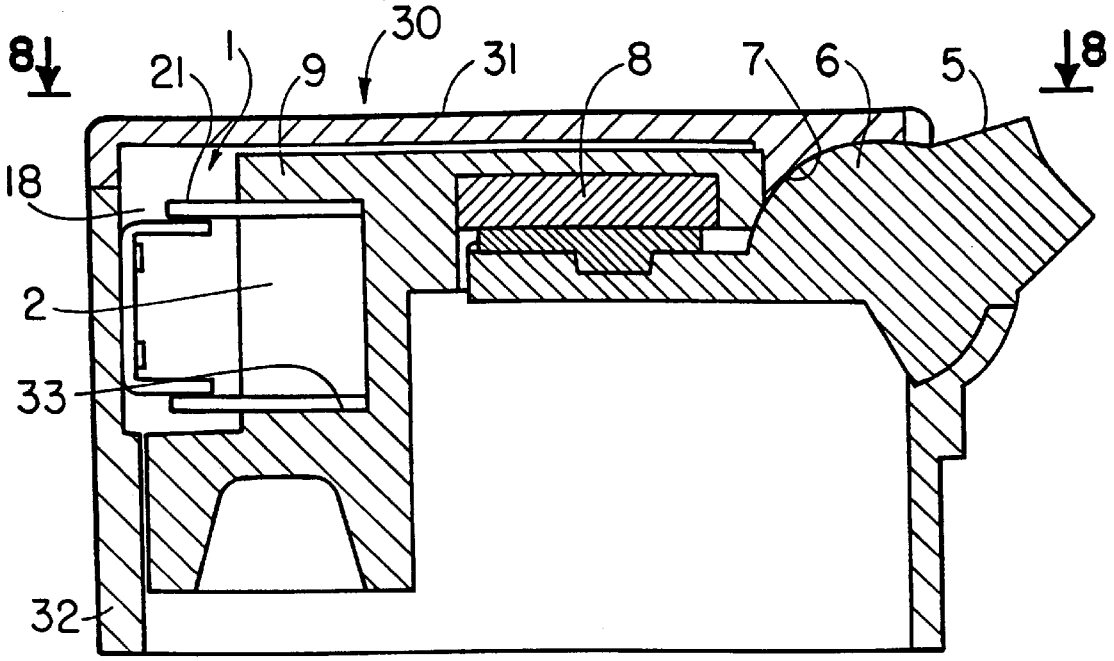
FIG. 7 is a view in diagrammatic axial cross section of a rocker switch equipped with magnetic indexing means in accordance with the invention.

In FIGS. 7 and 8 four targets 18, which are joined together by bar elements, are provided. These targets, which are carried by the skirt 32, are U-shaped, having free ends of trapezoidal shape arranged to penetrate with a slight clearance between the pole pieces 21 of FIG. 2.

The magnet 2 with its pole pieces 21, defining a counter-target, is mounted in an axially oriented recess 33 in the form of a blind hole formed in a head 9 which is coupled to the dolly 5 by coupling means 8. The head 9 is thus part of the operating member 5.

In this example, the coupling means 8 make use of intermediate members and connections by mating cooperation. In a modification, the head 9 is a single component penetrating into the element 5.

Figure 9:
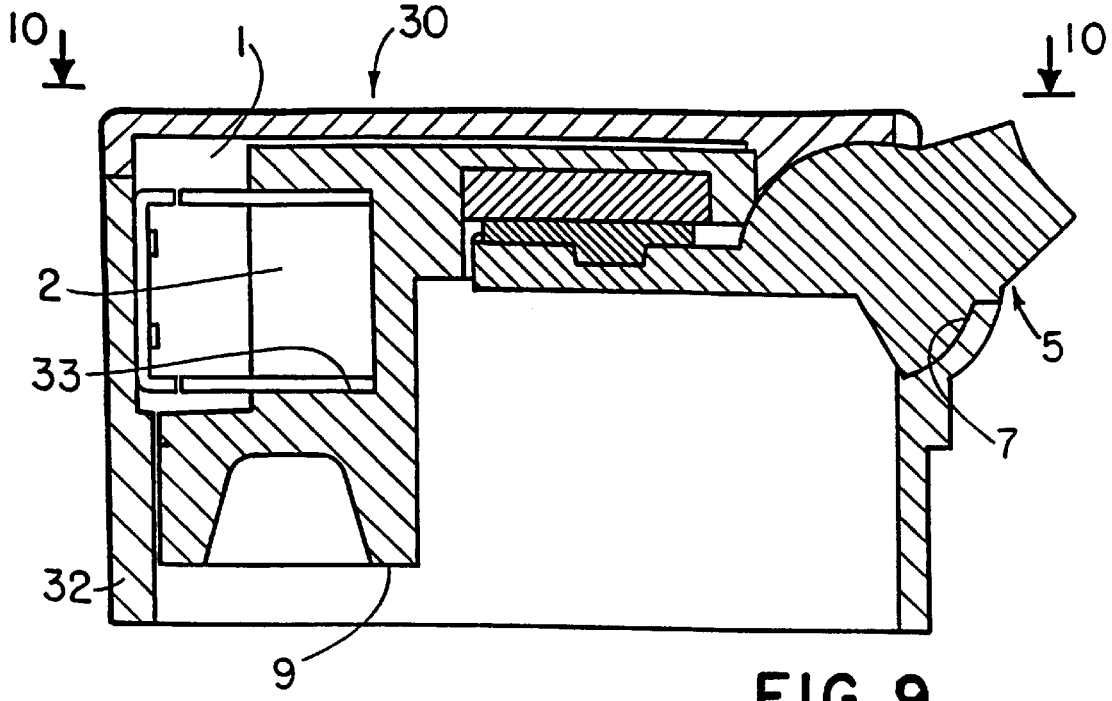
FIGS. 9, 10 and 11, 12 are views similar to FIGS. 7 and 8 for a second and a third embodiment respectively.
Figure 10:
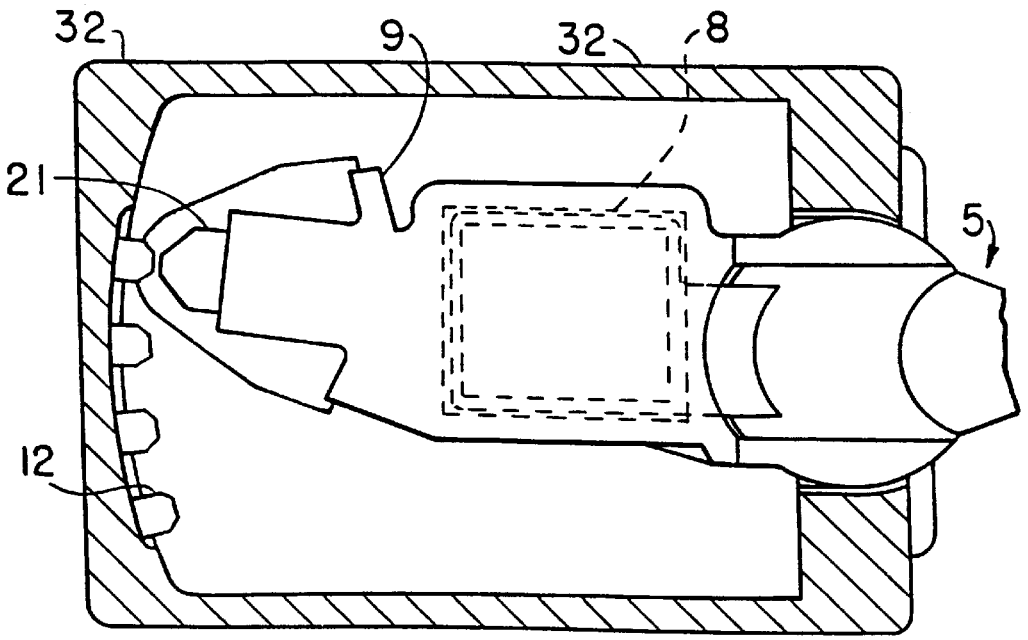

In FIGS. 9 and 10, the magnetic circuit includes the targets 12 of the same type in FIG. 2, and pole pieces 21 as in that same Figure.

Figure 11:
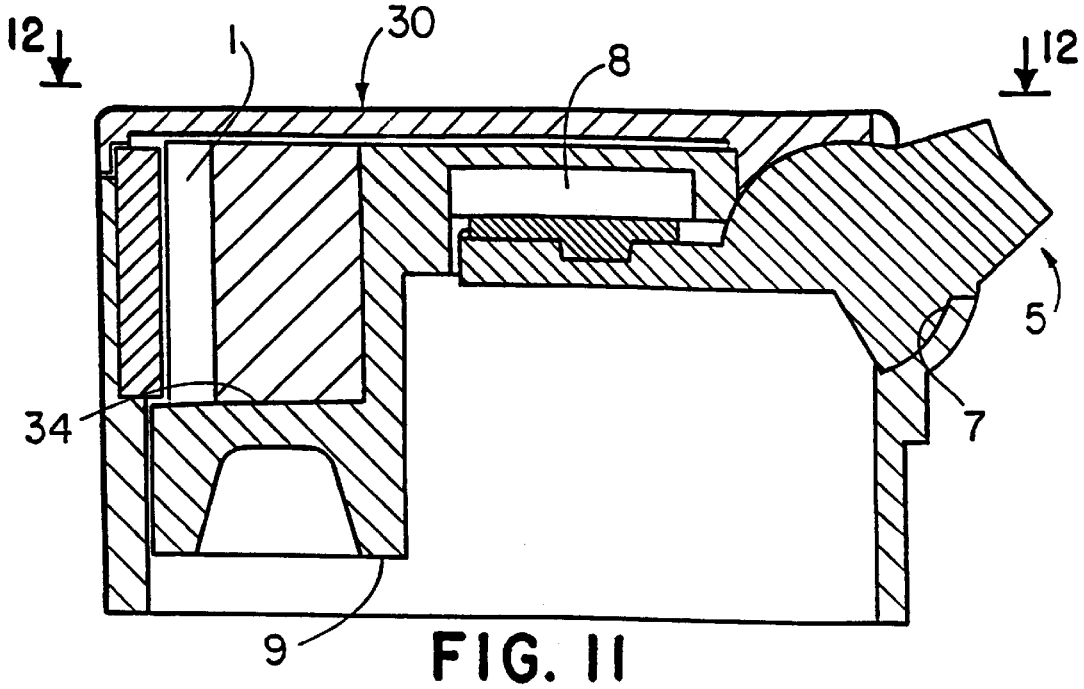
Figure 12:
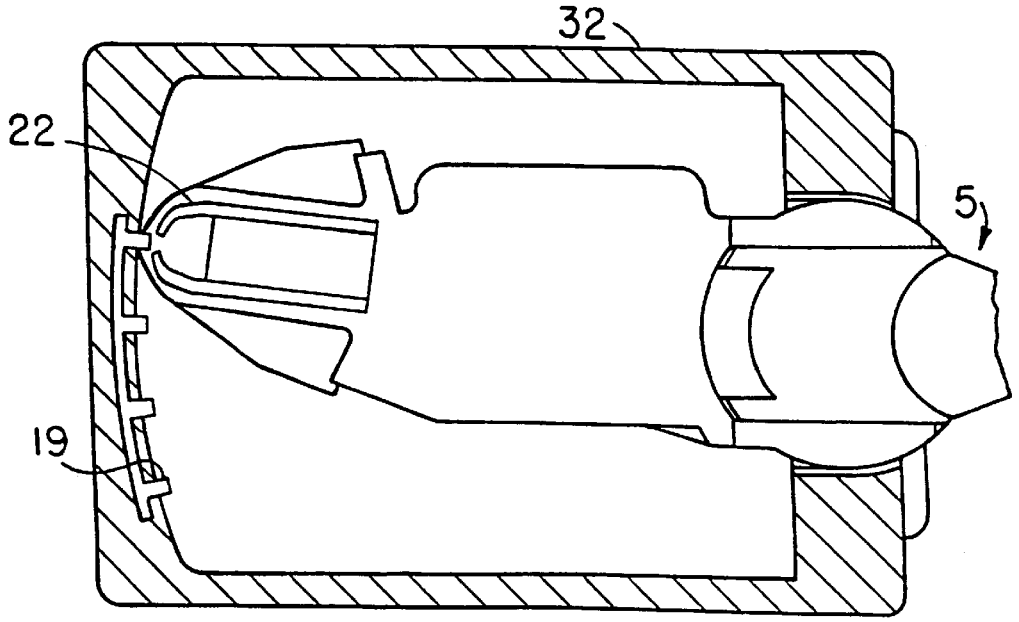

In FIGS. 11 and 12, the targets 19 are of the same type as those in FIG. 3, having a free end of rectangular shape, while the pole pieces 22 (the counter-target) have the same shape as that in FIG. 3, and are mounted in an open transverse recess 34 of the head 9.

In this example the targets 19 with their bar elements are moulded into the rounded internal lateral edge of the skirt 32, as in FIGS. 8 and 10.

It will be seen that the fastening of the targets in FIGS. 7 to 12 is easily carried out, either by moulding-on or possibly by riveting, or otherwise.

It will be appreciated that the magnet in FIGS. 11 and 12 is larger and more powerful, and that it is possible to orientate the magnet with its counter-target in either direction (axial or transverse), which leads to wide applicability.

Figure 14:
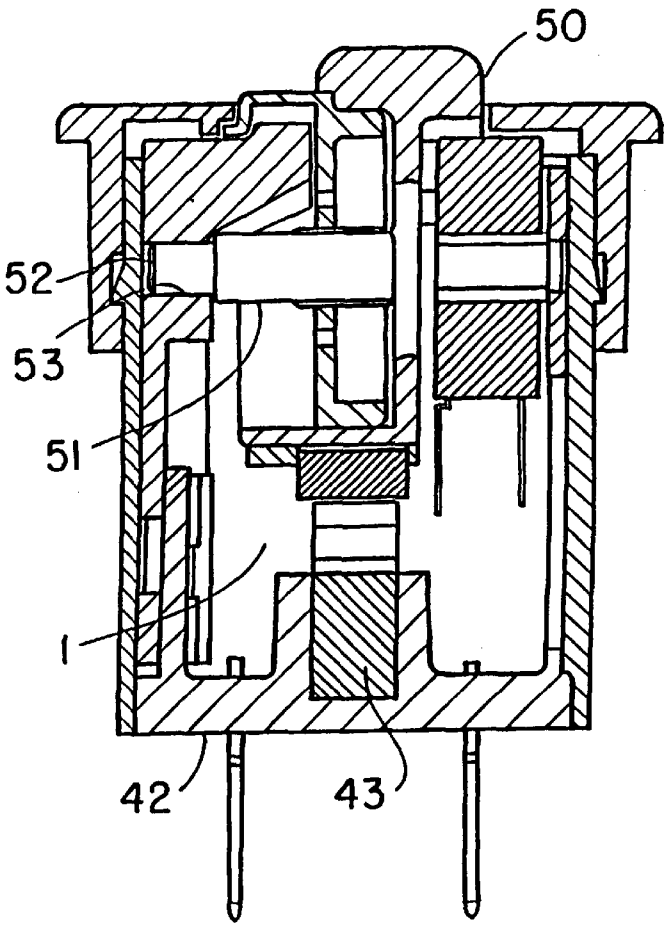
FIG. 14 is a view in cross section taken on the line 14—14 in FIG. 13.
Figure 13:
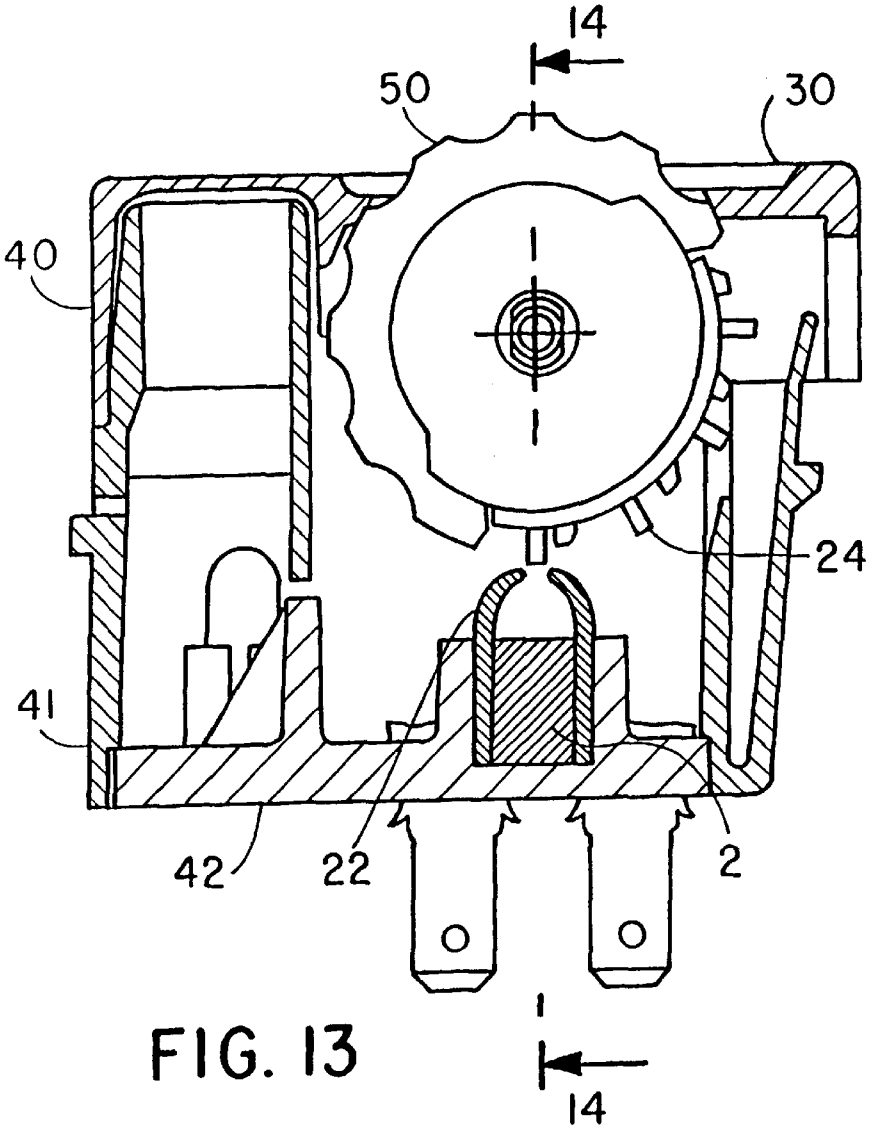
FIG. 13 is a view in diagrammatic axial cross section of a switch having a rotary operating member and equipped with magnetic indexing means in accordance with the invention.

In FIGS. 13 to 14, the operating member is a rotary knob 50 for actuation by the user, and the switch is an electrical control selector as described in the document FR-A-2 675 918 (U.S. Pat. No. 5,235,213).

In this case, the operating member is mounted for rotation by means of a spindle 51 with which it is provided for this purpose, and which is rotatable in a bore 52 in the housing 30. For this purpose, the spindle 51 has an end portion of a reduced diameter 53, penetrating into the bore 52. The housing 30, of plastics material, here has three parts, namely a cover 40, a skirt 41 and a circuit board 42 carrying electronic circuits, electrical connecting tongues and a lighting lamp of which can be seen in FIG. 13. The fitting of these various components is done by clipping action.

It is the circuit board 42 that has a recess 43 for fitting of a magnet 2 with a pole piece 22 of the same type as in FIG. 3. In this case, the targets 24 are carried by the knob or operating member 50, and are therefore rotatable with respect to the magnet 2, which is fixed.

The targets 24 come into facing relationship with the free ends of the pole pieces 22.

The switch may of course control hydraulic or other circuits, and it is possible to carry out relative linear movement of the targets with respect to the counter-targets. In that case, for example, the magnet 2 with its counter-target is part of a cursor which is displaced in linear motion by the user.

In all cases, the operating member is not controlled by pushing, but by circumferential deflection, which may be of infinite radius giving an axial motion.

It is of course possible to increase the number of targets and/or counter-targets in accordance with the particular application.

It will be appreciated that the magnetic forces are determined in accordance with the particular application, and easily, as a function of the air gaps and pole pieces in particular, in such a way that the operating member remains in a stable position when subjected to vibration.

I claim:

1. A switch having at least two stable switch positions, for a motor vehicle, comprising a support housing a rotatable operating member carried by the support housing for occupying the stable positions, and indexing means carried by the operating member and by the housing to define the stable positions of the operating member, the indexing means being rotatable by the operating member, the indexing means having a magnetic circuit with at least one permanent magnet for establishing a magnetic field with a magnetic flux coupled to at least one counter-target and a target for closing the magnetic field, the target being disposed in facing relationship to the counter-target at each stable position, the counter-target and the permanent magnet associated with the counter-target established in the facing relationship with the target by the operating member and by the housing to define at least two stable positions between at least two targets and one counter-target.

2. A switch according to claim 1, further comprising a pole piece associated with each pole of the permanent magnet in order to reduce the permanent magnet power.

3. A switch according to claim 2 further comprising pole pieces twinned and shaped to define the counter-targets.

4. A switch according to claim 2, characterised in that the pole pieces are profiled to increase the magnetic field flux.

5. A switch according to claim 4, wherein the pole pieces further comprise at least one end, the pole piece having a flat shape and the free end thereof having a trapezoidal shape.

6. A switch according to claim 5, wherein the targets further comprise a U-shape with two branches, each of said branches having a free end thereof directed towards the pole pieces, each of the free ends being a trapezoidal shape.

7. A switch according to claim 4, wherein each of the pole pieces further comprise a respective free end, the free ends each being turned in toward each other to define an air gap therebetween.

8. A switch according to claim 7, wherein the target further comprises a lug having a free end of trapezoidal shape, the trapezoidal free end penetrating between the free ends of the respective pole pieces.

9. A switch according to claim 7, wherein the target further comprises a bar having a free end of trapezoidal shapes, said trapezoidal free end being in facing relationship with the free ends of the pole pieces.

10. A switch according to claim 1, wherein the permanent magnet with its pole pieces further comprises a head for carrying the pole pieces and a dolly, the dolly being part of the head, articulated in the housing.

11. A switch according to claim 1 in that the permanent magnet (2) with its pole pieces (20, 21 further comprising a circuit board on the housing, an operating knob for carrying the targets, the operating knob being mounted for rotation in the housing.

* * * * *

UNITED STATES PATENT AND TRADEMARK OFFICE

CERTIFICATE OF CORRECTION

PATENT NO. : 5,864,272

DATED : January 26, 1999

INVENTOR(S) : Bertrand HOFFMANN

It is certified that error appears in the above-identified patent and that said Letters Patent is hereby corrected as shown below:

At Column 8, line 14, delete "shapes" and insert --shape--

At Column 8, lines 20 and 21 delete [in that the permanent magnet (2) with its pole pieces (20.21].

Signed and Sealed this

Thirteenth Day of July, 1999

*Attest:*

*Attesting Officer*

Q. TODD DICKINSON

*Acting Commissioner of Patents and Trademarks*